US009797081B2

(12) United States Patent
Miller et al.

(10) Patent No.: US 9,797,081 B2
(45) Date of Patent: Oct. 24, 2017

(54) LAUNDRY TREATING APPLIANCE SUSPENSION SYSTEM

(71) Applicant: WHIRLPOOL CORPORATION, Benton Harbor, MI (US)

(72) Inventors: Christoph J. Miller, Saint Joseph, MI (US); John L. Patera, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/094,525

(22) Filed: Apr. 8, 2016

(65) Prior Publication Data

US 2016/0222571 A1 Aug. 4, 2016

Related U.S. Application Data

(63) Continuation of application No. 12/894,503, filed on Sep. 30, 2010, now Pat. No. 9,340,916.

(60) Provisional application No. 61/323,451, filed on Apr. 13, 2010.

(51) Int. Cl.

| | |
|---|---|
| ***D06F 37/20*** | (2006.01) |
| ***D06F 37/26*** | (2006.01) |
| ***D06F 37/12*** | (2006.01) |
| ***D06F 37/24*** | (2006.01) |

(52) U.S. Cl.

CPC ..... *D06F 37/268* (2013.01); *D06F 37/12* (2013.01); *D06F 37/20* (2013.01); *D06F 37/24* (2013.01)

(58) Field of Classification Search

CPC ..... D06F 37/268

See application file for complete search history.

(56) References Cited

U.S. PATENT DOCUMENTS

| | | | | |
|---|---|---|---|---|
| 3,373,961 | A | 3/1968 | Long | |
| 3,703,091 | A | 11/1972 | Steele | |
| 5,117,659 | A | 6/1992 | Sharp et al. | |
| 5,606,879 | A | 3/1997 | Froelicher et al. | |
| 5,946,946 | A | 9/1999 | Sharp et al. | |
| 6,397,643 | B1 | 6/2002 | Chang et al. | |
| 6,474,113 | B1 | 11/2002 | Park | |
| 6,591,640 | B2 | 7/2003 | Park | |
| 2006/0231725 | A1* | 10/2006 | Rebolledo | F16F 1/128 248/638 |
| 2007/0137264 | A1* | 6/2007 | Kawabata | D06F 37/20 68/140 |
| 2007/0251278 | A1 | 11/2007 | Barcha et al. | |

FOREIGN PATENT DOCUMENTS

| | | | |
|---|---|---|---|
| GB | 2082635 | A | 3/1982 |
| JP | 52054274 | A | 5/1977 |
| JP | 52055268 | A | 5/1977 |
| JP | 53069474 | A | 6/1978 |
| JP | 60018198 | A | 1/1985 |
| JP | 60185588 | A | 9/1985 |

(Continued)

*Primary Examiner* — Michael Barr
*Assistant Examiner* — Jason Riggleman

(57) ABSTRACT

A suspension system for a laundry treating appliance having a cabinet and a tub comprises a rod coupled to the cabinet and a shock absorber coupled between the rod and the tub. A socket interface on the rod reduces side loading forces on the shock absorber. The socket interface may be separate from the shock absorber.

6 Claims, 4 Drawing Sheets

(56) References Cited

FOREIGN PATENT DOCUMENTS

| | | | | |
|---|---|---|---|---|
| JP | 62122698 | A | | 6/1987 |
| JP | 2092396 | A | | 4/1990 |
| JP | 2198592 | A | | 8/1990 |
| JP | 8022356 | B | | 3/1996 |
| JP | 9155095 | A | | 6/1997 |
| JP | 2000126490 | | | 5/2000 |
| JP | 2000-288288 | | * | 10/2000 |
| JP | 2000288288 | | | 10/2000 |
| JP | 2002143594 | A | | 5/2002 |
| JP | 3474597 | B | | 12/2003 |
| JP | 2008054936 | A | | 3/2008 |
| KR | 20000007901 | A | | 2/2000 |
| KR | 20010088201 | A | | 9/2001 |
| KR | 20030004712 | A | | 1/2003 |
| KR | 100799632 | B1 | | 1/2008 |
| WO | 9637651 | A1 | | 11/1996 |

* cited by examiner

LAUNDRY TREATING APPLIANCE SUSPENSION SYSTEM

CROSS REFERENCE TO RELATED APPLICATIONS

The present application is a continuation and claims the benefit of U.S. application Ser. No. 12/894,503, filed Sep. 30, 2010, now U.S. Pat. No. 9,340,916, issued May 17, 2016, which claims the benefit of U.S. Provisional Patent Application No. 61/323,451, filed Apr. 13, 2010, both of which are incorporated herein by reference in their entireties.

BACKGROUND OF THE INVENTION

Laundry treating appliances, such as a washing machine or a clothes dryer, may include an outer cabinet and a tub housed within the cabinet and coupled to the cabinet by a suspension system. Such suspension systems may include a plurality of suspension strut assemblies which hang the tub from the cabinet. Each suspension strut assembly may have dampening means for reducing the movement and vibration of the tub.

SUMMARY OF THE INVENTION

The invention relates to a laundry treating appliance having a cabinet defining an interior and a tub located within the interior and having at least one socket with a passage therethrough. The at least one suspension strut assembly has an elongated rod defining a longitudinal axis and extending through the socket passage, with a first end on a first side of the socket and coupled to the cabinet, and a second end, opposite the first end and on a second side, opposite the first side of the socket. A shock absorber is positioned on the elongated rod and located between the second end and the at least one socket, the shock absorber having a domed end cap facing the at least one socket. A socket interface is provided on the elongated rod between the socket and the shock absorber, the socket interface having a cone-shaped body. The cone-shaped body has a base with a domed surface nested in the socket and positioned between the socket and the shock absorber, a top, opposite and spaced from the base, and defining a top surface abutting the domed end cap, the top surface being smaller than the domed surface, and a side surface extending from the domed surface to the top surface and tapering down in a direction from the domed surface to the top surface.

DESCRIPTION OF EMBODIMENTS OF THE INVENTION

Figure 1:
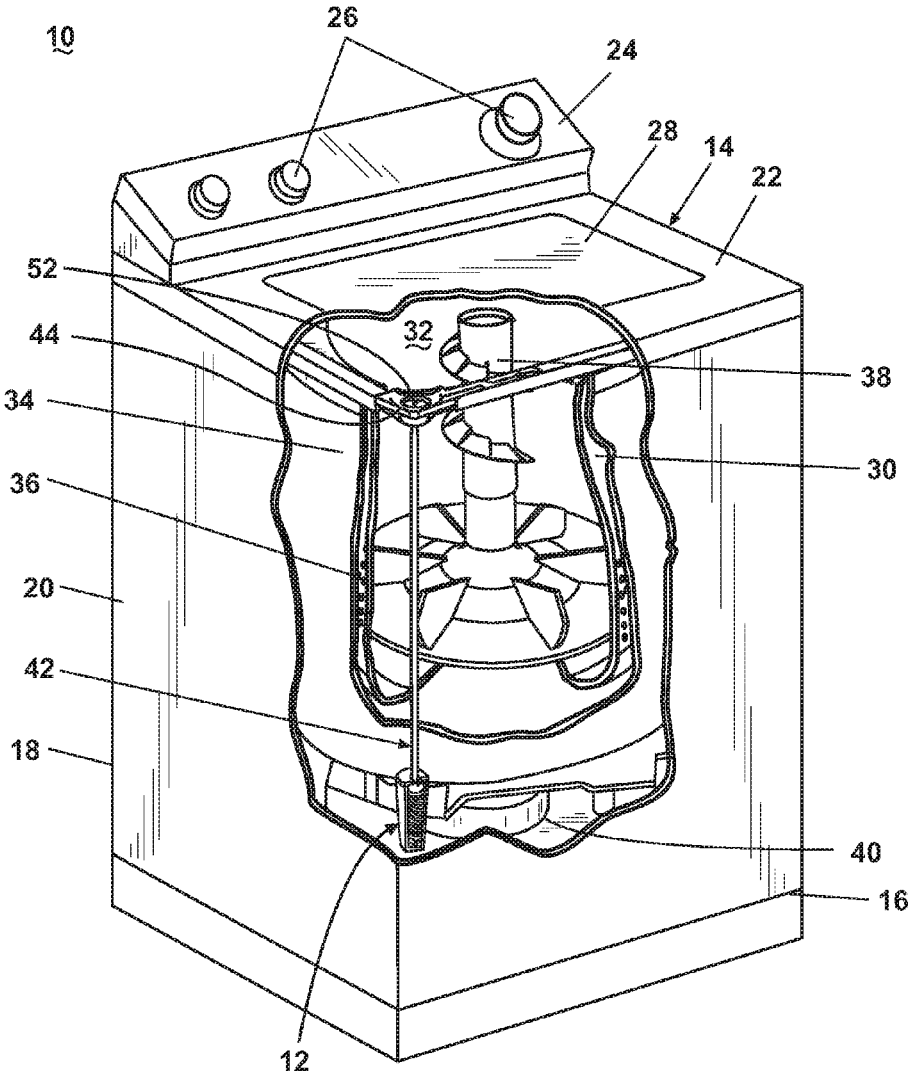
FIG. 1 is a perspective view of a laundry treating appliance, with a portion of the laundry treating appliance partially cut away to show interior components, including a suspension system according to one embodiment of the invention.

The present invention relates to a suspension system for an appliance, such as a laundry treating appliance. In particular, one embodiment of the invention relates to a laundry treating appliance suspension system having an improved force management. FIG. 1 illustrates one embodiment of a laundry treating appliance 10 having a suspension system 12 according to one embodiment of the invention. As illustrated, the laundry treating appliance 10 is a vertical-axis washing machine; however, the laundry treating appliance 10 may be any appliance which performs a cycle of operation on laundry, non-limiting examples of which include a horizontal-axis washing machine; a horizontal or vertical axis clothes dryer; a combination washing machine and clothes dryer; a tumbling or stationary refreshing/revitalizing machine; an extractor; a non-aqueous washing apparatus; and a revitalizing machine. As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination. The laundry treating appliance 10 described herein shares many features of a traditional automatic washing machine, which will not be described in detail except as necessary for a complete understanding of the invention. It is also understood that the suspension system 12 is applicable to appliances other than laundry treating appliances.

As illustrated in FIG. 1, the laundry treating appliance 10 may have a cabinet 14 defined by a front wall 16, a rear wall 18, and a pair of side walls 20 supporting a top wall 22. A user interface 24 on the cabinet 14 has multiple controls 26, which a user can select to operate the laundry treating appliance 10 through the steps of a wash cycle. A chassis or frame may be provided on which the various walls may be mounted.

The top wall 22 may have an openable door or lid 28 and may be selectively moveable between opened and closed positions to close an opening in the top wall 22, which provides access to the interior of the cabinet 14. A rotatable drum 30 may be disposed within the interior of the cabinet 14 and defines a treating chamber 32 for treating laundry. The drum 30 may be positioned within an imperforate tub 34. The drum 30 may include a plurality of perforations 36, such that liquid may flow between the tub 34 and the drum 30 through the perforations 36. A clothes mover 38 may be located in the drum 30 to impart mechanical agitation to a load of clothing articles placed in the drum 30. An electric motor 40 may be coupled to the clothes mover 38 and may be located beneath the tub 34.

At least the tub 34 is supported within the cabinet 14 by the suspension system 12. The suspension system 12 can comprise a plurality of suspension strut assemblies 42, only one of which is visible in FIG. 1, which hang the tub 34 from the cabinet 14. While the illustrated laundry treating appliance 10 includes both the tub 34 and the drum 30, with the drum 30 defining the laundry treating chamber 32, it is within the scope of the invention for the laundry treating appliance 10 to include only one receptacle, with the receptacle defining the laundry treating chamber for receiving the laundry load to be treated and supported by the suspension system 12.

Figure 2:
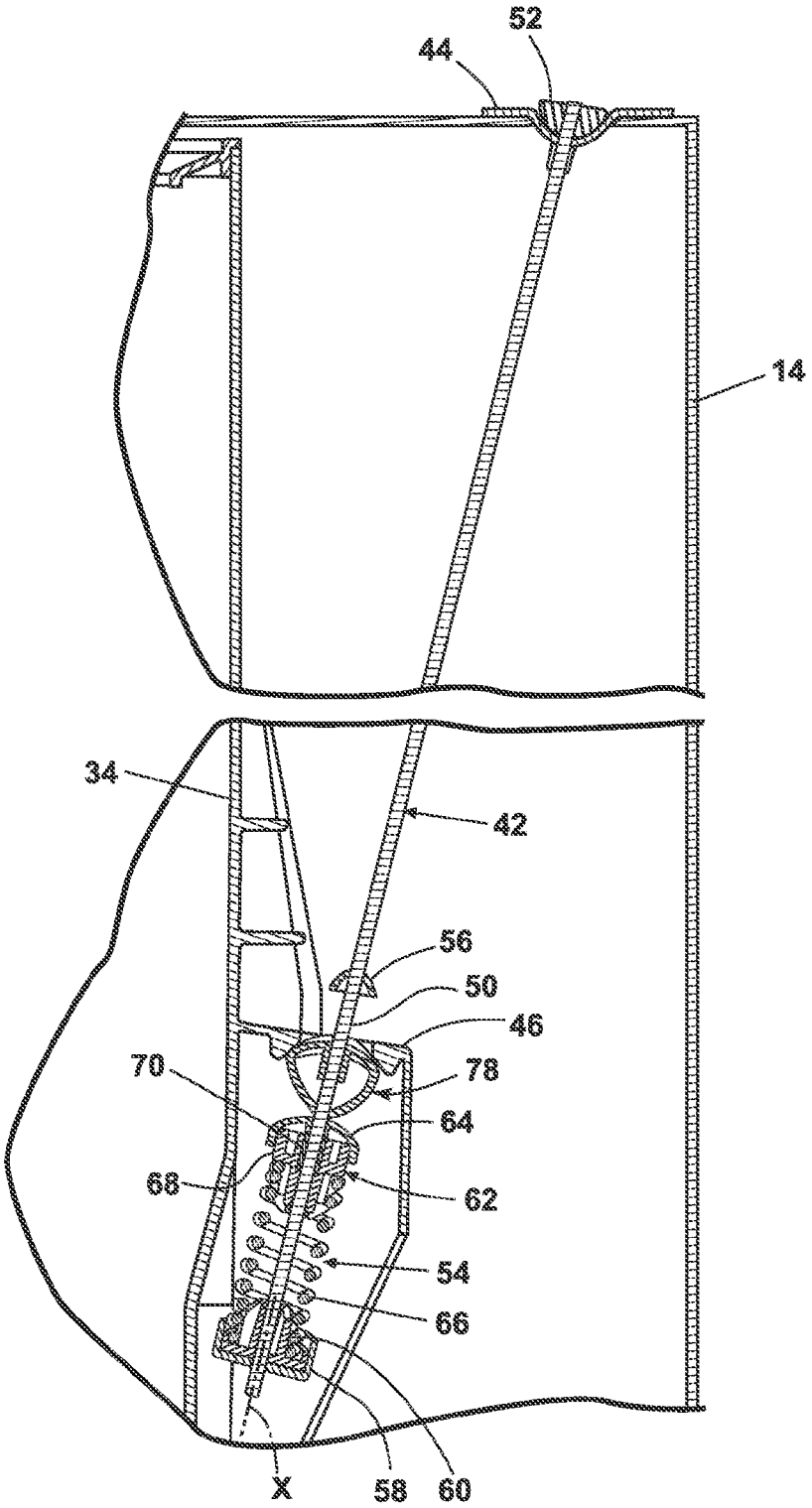
FIG. 2 is a partial sectional view of the laundry treating appliance from FIG. 1 and illustrating one suspension strut assembly of the suspension system.

FIG. 2 is a partial sectional view of the laundry treating appliance 10 from FIG. 1. Each suspension strut assembly 42 may be coupled to the cabinet 14 by one or more brackets 44, which can be positioned near the top corners of the cabinet 14, and to the tub 34 by one or more sockets 46, which can be integrally formed with or attached to a lower portion of the tub 34. Each suspension strut assembly 42 comprises a rod 50 having an upper support 52 at a first end of the rod 50 which is coupled to the bracket 44 and a shock absorber 54 at a second end of the rod 50, opposite the upper support 52, which is coupled to the socket 46. A stop 56 is also coupled to the rod 50 and functions to limit the upward movement of the tub 34 within the cabinet 14.

The shock absorber 54 may comprise a first end cap 58, a piston 60, a damper 62, a second end cap 64, and a spring 66. The end caps 58, 64, piston 60, and damper 62 may be mounted on the rod 50, with the first end cap 58 nearest the terminal end of the rod 50, the piston 60 adjacent the first end cap 58, the damper 62 spaced from both the first end cap 58 and the piston 60, and the second end cap 64 adjacent the damper 62. The spring 66 may be mounted around the piston 60 and is positioned between the first end cap 58 and the damper 62. The spring 66 allows compliance in the connection of the tub 34 to the cabinet 14, aiding to reduce vibration and allow the tub 34 to move freely within the cabinet 14. The damper 62 may provide friction force that is used to reduce the movement and vibration of the tub.

Figure 3:
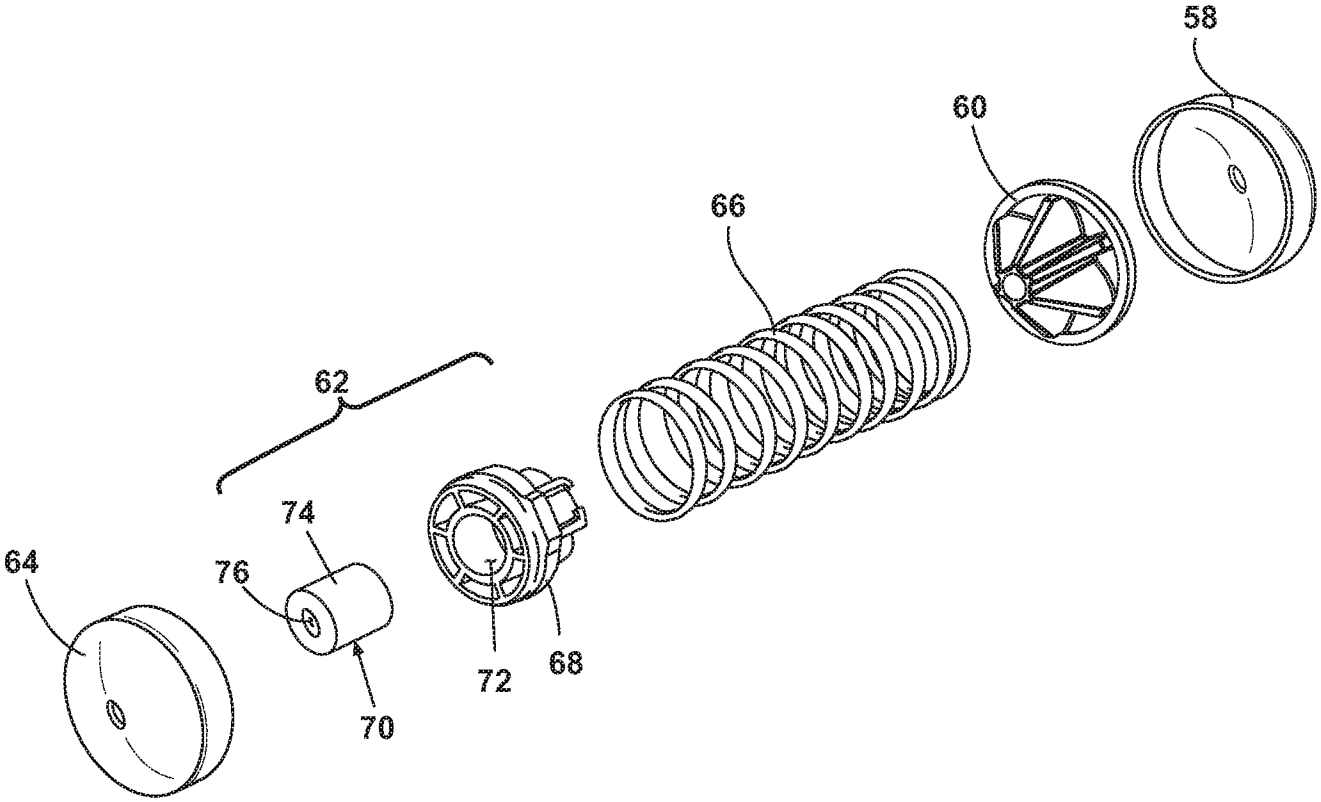
FIG. 3 is an exploded view of a portion of the suspension system of FIG. 1, including a spring and damper of the suspension strut assembly.

FIG. 3 is an exploded view of a portion of the suspension system 12 of FIG. 1. The damper 62 may include an outer housing 68 a dampening insert 70 received by a chamber 72 in the outer housing 68. The dampening insert 70, which is illustrated as a compressible friction member, may be a tube 74 of foam material having a passage 76 for receiving the rod 50. The inner diameter of the tube 74, i.e. the diameter of the passage 76, may be smaller than the outer diameter of the rod 50, causing the inner surface of the tube 74 to compress outwardly in order for the tube 74 to stretch over the rod 50. The outer diameter of the tube 74 may be greater than the diameter of the chamber 72, thereby compressing at least the outer surface of the tube 74 inwardly. As the damper 62 moves relative to the rod 50, the friction force of the foam tube 74 compressed on the rod resists the movement. Thus, the radial compression of the foam tube 74 in towards the rod 50 produces a damping force that hampers axial movement of the shock absorber 54 along the rod 50. The dual compressive forces created by the foam tube 74 also increase the friction force generated when the damper 62 is moved relative to the stationary rod 50, thereby generating heat.

The foam tube 74 may be injected with grease, which helps conduct frictional heat away from the rod 50 so that the damper 62 does not overheat. The grease also helps lubricate the interface between the tube 74 and the rod 50 to prevent the foam material from damage caused by repetitive movement relative to the rod 50. The grease can also help make the foam material more compliant and less stiff to further protect the tube 74 from damage. Alternatively, the dampening insert 70 may be made as a strip of foam wrapped around the rod 50 or simply compressed in some manner and designed to function similarly to the foam tube 74 described above.

As shown in FIG. 2, a force director illustrated in the form of a socket interface 78 may be positioned on the rod 50 between the socket 46 and the shock absorber 54, and functions to redirect force on the shock absorber 54 to a vector that is substantially coaxial with a longitudinal axis X of the rod 50. The socket interface 78 may be a separate component from the shock absorber 54.

Figure 4:
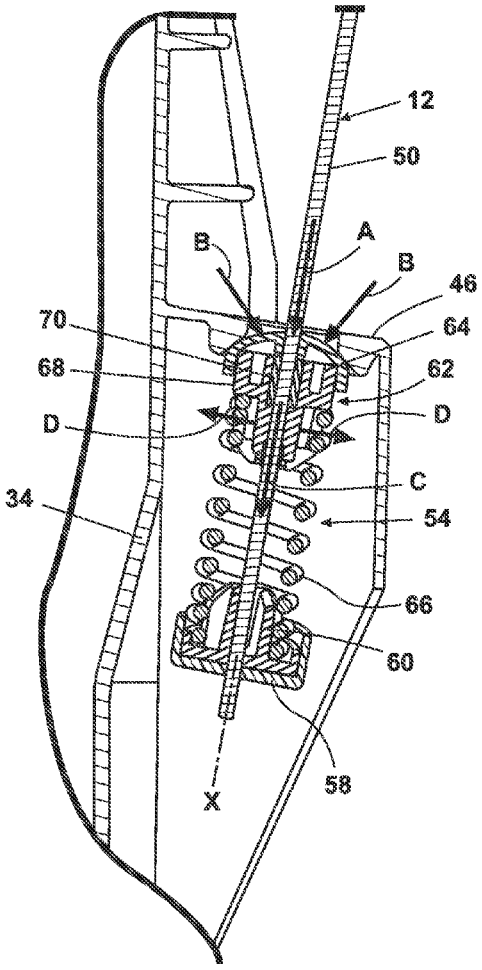
FIG. 4 is a partial sectional view of the laundry treating appliance from FIG. 1, illustrating forces acting on the suspension system without the socket interface.

FIG. 4 is a partial sectional view of the laundry treating appliance 10 from FIG. 1, illustrating forces acting on the suspension system 12 without the socket interface 78. Ideal force, represented by vector A, transmitted to the shock absorber 54 would be coaxial with the axis X of the rod 50. However, in reality, due to the suspension interface with the tub 34, actual force, represented by vectors B is imparted onto the shock absorber 54 at an angle to the axis X. Because the actual force B is not parallel to the axis X, a portion of the force transmitted back by the shock absorber 54 will not be parallel to the axis X. One portion will be redirected in an axial direction, represented by vector C, while the other portion is redirected in the radial direction, represented by vector D. The force vector D acting perpendicular to the rod 50 adds a side loading to the damper 62, which may torque the damper 62 in the direction of vector D while it moves along the rod 50.

The torque applied to the damper 62 while it oscillates up and down relative to the rod 50 during a cycle of operation of the laundry treating appliance 10 can prematurely wear and damage the foam material of the dampening insert 70, which reduces the effectiveness of the damper 62 in producing friction force to reduce the movement and vibration of the tub 34. If the side loading is great enough, the suspension assembly 12 can fail within a single cycle of operation of the laundry treating appliance 10.

Figure 5:
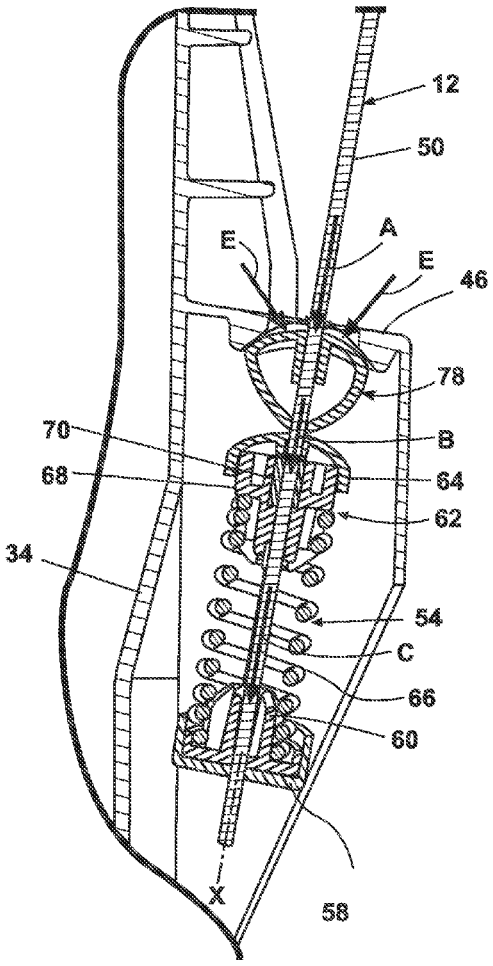
FIG. 5 is a partial sectional view of the laundry treating appliance from FIG. 1, illustrating forces acting on the suspension system with the socket interface.

FIG. 5 is a partial sectional view of the laundry treating appliance 10 from FIG. 1, illustrating forces acting on the suspension system 12 with the socket interface 78. The socket interface 78 helps to manage any aspects of side loading to ensure the suspension assembly 12 does not fail and the laundry treating appliance 10 remains operable. Similarly to FIG. 5, actual force, represented by vectors E is imparted onto the socket interface 78 at an angle to the axis X. However, due to the shape of the socket interface 78, actual force, represented by vector B, imparted onto the shock absorber 54 is coaxial with the axis X, and is therefore, collinear with the ideal force vector A. Because the actual force B is parallel to the axis X, the force transmitted back by the shock absorber 54, represented by vector C, will be parallel to the axis X. Without any substantial radially-directed force transmitted back, there will be no substantial side loading on the damper 62.

The invention described herein provides a suspension system with improved force management. The socket interface 78 of the suspension system 12 redirects forces acting on the suspension system 12 to be parallel to the rod 50, which is ideal. This reduces or eliminates side loading on the damper 62, which increases the effectiveness of the damper 62 and reduces the possibility of suspension failure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:

a cabinet defining an interior;

a tub located within the interior and having at least one socket with a passage therethrough;

at least one suspension strut assembly having an elongated rod defining a longitudinal axis and extending through the socket passage, with a first end on a first side of the socket and coupled to the cabinet, and a second end, opposite the first end and on a second side, opposite the first side of the socket;

a shock absorber positioned on the elongated rod and located between the second end and the at least one socket, the shock absorber having a domed end cap facing the at least one socket; and a socket interface provided on the elongated rod between the socket and the shock absorber, the socket interface having a cone-shaped body comprising:

a base with a domed surface nested in the socket and positioned between the socket and the shock absorber;

a top, opposite and spaced from the base, and defining a top surface abutting the domed end cap, the top surface being smaller than the domed surface; and a side surface extending from the domed surface to the top surface and tapering down in a direction from the domed surface to the top surface.

2. The laundry treating appliance of claim 1 wherein forces imparted on the shock absorber by motion of the tub are redirected by the socket interface to a vector that is substantially coaxial with the longitudinal axis.

3. The laundry treating appliance of claim 1 wherein the base is convex.

4. The laundry treating appliance of claim 3 wherein the shock absorber comprises a second end cap disposed opposite the shock absorber from the socket interface.

5. The laundry treating appliance of claim 1 wherein the cone-shaped body has a passage therethrough that receives the elongated rod.

6. The laundry treating appliance of claim 1 wherein the cone-shaped body is substantially hollow with a passage there-through that receives the elongated rod.

* * * * *